US011346183B2

(12) United States Patent
Mair et al.

(10) Patent No.: US 11,346,183 B2
(45) Date of Patent: May 31, 2022

(54) MULTI-PISTON ACTIVATION MECHANISM

(71) Applicant: Halliburton Energy Services, Inc., Houston, TX (US)

(72) Inventors: Ryan David Mair, Inverurie (GB); Michael Adam Reid, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 311 days.

(21) Appl. No.: 16/491,266

(22) PCT Filed: Dec. 5, 2018

(86) PCT No.: PCT/US2018/064040
§ 371 (c)(1),
(2) Date: Sep. 5, 2019

(87) PCT Pub. No.: WO2020/117225
PCT Pub. Date: Jun. 11, 2020

(65) Prior Publication Data

US 2021/0324710 A1 Oct. 21, 2021

(51) Int. Cl.
*E21B 23/04* (2006.01)
*E21B 34/10* (2006.01)
*E21B 34/08* (2006.01)

(52) U.S. Cl.
CPC ..... *E21B 34/102* (2013.01); *E21B 23/04* (2013.01); *E21B 34/085* (2013.01)

(58) Field of Classification Search
CPC .... E21B 23/04; E21B 23/0421; E21B 34/102; E21B 34/085
See application file for complete search history.

(56) References Cited

U.S. PATENT DOCUMENTS 3,967,647 A 7/1976 Young
4,197,879 A 4/1980 Young
(Continued)

FOREIGN PATENT DOCUMENTS

WO 2014043028 3/2014

OTHER PUBLICATIONS

International Application No. PCT/US2018/064040, "International Search Report and Written Opinion", dated Aug. 14, 2019, 10 pages.
(Continued)

*Primary Examiner* — Cathleen R Hutchins
(74) *Attorney, Agent, or Firm* — Kilpatrick Townsend & Stockton LLP

(57) ABSTRACT

An actuator assembly of a downhole tool may include a high pressure chamber and a low pressure chamber. A pressure applied from the surface to the tool may enter both chambers. The low pressure chamber may include an inlet that restricts the flow of pressure and prevents the pressure within the low pressure chamber from increasing quickly. The high pressure chamber may also include an inlet that restricts the flow of pressure to prevent the pressure within the high pressure chamber from increasing quickly. The inlet of the high pressure chamber may also include a check valve that prevents pressure from bleeding off from the high pressure chamber through the check valve. The pressure within the high pressure chamber may actuate a piston to actuate the tool in response to the pressure applied from the surface falling within a predetermined pressure and time range.

20 Claims, 10 Drawing Sheets

(56) References Cited

U.S. PATENT DOCUMENTS

| | | | | |
|---|---|---|---|---|
| 4,254,836 | A | 3/1981 | Russell | |
| 4,293,038 | A | 10/1981 | Evans | |
| 4,542,792 | A | 9/1985 | Akkerman | |
| 4,550,780 | A | 11/1985 | Mott | |
| 6,378,612 | B1 | 4/2002 | Churchill | |
| 7,926,575 | B2 * | 4/2011 | Ringgenberg | E21B 34/102 166/375 |
| 2010/0051289 | A1 | 3/2010 | Constantine et al. | |
| 2012/0018172 | A1 | 1/2012 | Javed | |
| 2012/0118579 | A1 | 5/2012 | Murray et al. | |
| 2015/0285043 | A1 | 10/2015 | Airey et al. | |
| 2016/0003005 | A1 * | 1/2016 | Pickle | E21B 34/10 166/374 |

OTHER PUBLICATIONS

U.S. Appl. No. 16/491,504, Non-Final Office Action, dated Feb. 16, 2022, 13 pages.

* cited by examiner

MULTI-PISTON ACTIVATION MECHANISM

TECHNICAL FIELD

The present disclosure relates generally to downhole tools positionable in a well system, and more specifically, though not exclusively, to downhole tools including an actuator assembly which provides for remote opening of a valve mechanism of the downhole tool.

BACKGROUND

A well system (e.g., oil or gas wells for extracting fluids from a subterranean formation) may include a tool having a remote actuator assembly positioned downhole, for example but not limited to tools having remotely actuated valve mechanisms. These tools may be actuated from a surface of a wellbore of the well system. Tools can include, but are not limited to, barrier valves and fluid loss control valves.

DETAILED DESCRIPTION

Figure 1:
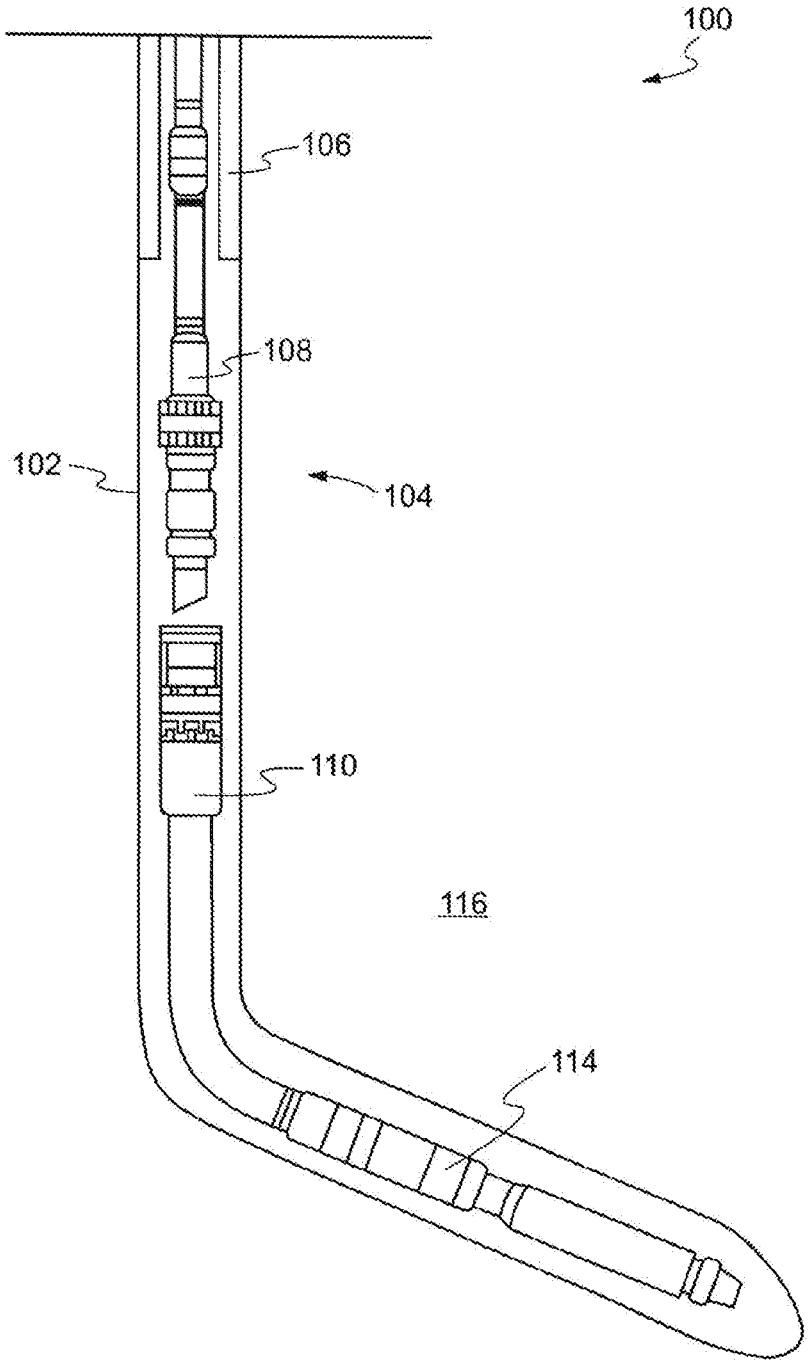
FIG. 1 is a schematic illustration of a well system including a downhole tool, according to an aspect of the present disclosure.

Certain aspects and examples of the disclosure relate a remote actuator assembly of a downhole tool positionable within a wellbore. The remote activation assembly can include multiple pistons for providing an on demand activation method to a barrier valve, fluid control device, or other device. The remote actuator assembly may be actuated in response to a pressure signal within a predetermined pressure window or command window being applied from the surface. The predetermined pressure window may be defined as a predetermined amount of pressure that is applied over a predetermine period of time. In some aspects, the predetermined amount of pressure may be a range of pressures. The remote actuator assembly may permit a pressure signal applied from the surface to be maintained or bled off prior to the actuation of the device.

In some aspects, the remote actuator assembly can provide for actuation of a downhole tool, for example but not limited to a ball valve, sliding sleeve, or flapper valve. Other downhole tools can utilize the remote actuator assembly should they be activated or functioned by means of hydraulic pressure or a mechanical actuator. Such downhole tools can be positioned within a well bore to isolate sections inside tubing, between a tubing and the annulus, or between a tubing and the formation. The remote actuator assembly can include a high pressure chamber and a low pressure chamber. A pressure signal from a surface may be applied to the downhole tool and may enter both the high and low pressure chambers. The low pressure chamber may include a restrictor device that includes an inlet restriction to prevent the pressure signal from the surface from increasing the pressure within the low pressure chamber too quickly. This inlet restriction may also allow the low pressure chamber to bleed off the pressure within the chamber until it is back to hydrostatic pressure once the pressure signal from the surface has been removed.

The high pressure chamber may also contain a restrictor device that includes an inlet restriction for a similar purpose, but the restrictor device may also include a check valve. The check valve may allow the pressure signal applied from the surface to quickly energize the high pressure chamber while preventing the pressure within the high pressure chamber from bleeding off through the check valve. The pressure within the high pressure chamber may bleed off slowly back through another inlet in the restrictor device once the pressure signal from the surface has been removed. Thus, an applied pressure signal from the surface may enter the high pressure chamber quickly, but will bleed off from the chamber slowly. The pressure within the high pressure chamber may act upon one or more pistons that are arranged to work together to actuate a device when the pressure signal falls within a predetermined pressure and time range (pressure window).

The low pressure chamber may direct pressure to an opposing side of the pistons as the high pressure chamber in response to the pressure signal applied from the surface. When the pressure signal is applied, the high pressure chamber has a fast increase in pressure to match the pressure signal, while the low pressure chamber may remain at the lower original pressure. This creates a pressure differential across the pistons, forcing them to travel and actuate a device if the pressure signal falls within the predetermined pressure window. The pressure within the high pressure chamber may also provide an actuation force for the downhole tool once activated.

In some aspects, the remote actuator assembly can be positioned within a fluid, for example a clean hydraulic fluid, and can include a primary piston that can actuate the device when the pressure signal from the surface falls within the predetermined pressure window. The primary piston may also prevent actuation of the device if the pressure signal falls below the predetermined pressure window. The remote actuator assembly can also include a second piston that can prevent actuation of the device if the pressure signal is above the predetermined pressure window. The emote actuator assembly can also include an optional third piston that can allow the device to be actuated in a second direction. The remote actuator assembly can route pressure applied from the surface (e.g. a pressure signal) to generate a pressure differential across the pistons of the assembly. This pressure differential can allow a user to actuate the remote actuator assembly without having to calculate the pressure downhole prior to determining an amount of pressure to apply as the pressure signal. The remote actuator assembly can also include resistors and check valves that allow pressure to slowly bleed off from the assembly which may avoid pressure surges in the well.

In some aspects, the remote actuator assembly can also include a boost spring for providing an additional boost force on the valve during actuation to add additional actuation force which may aid in predictable actuation of the device. In some aspects, the remote actuator assembly can actuate a device, for example a valve, repeatedly on demand from an open position to a closed position and vice versa. Moreover, by positioning the moving parts of the remote actuator assembly within a clean hydraulic fluid (e.g. hydraulic oil) the remote actuator assembly may be less likely to become damaged from debris and may function for longer with less maintenance.

FIG. 1 is a schematic illustration of a well system 100 that includes a bore that is a wellbore 102 extending through various earth strata. The wellbore 102 has a substantially vertical section 104 that may include a casing string 106 cemented at an upper portion of the substantially vertical section 104. The well system 100 may include an upper completion 108 positioned proximate to the casing string 106. The well system 100 may also include a lower completion string 110 positioned below the upper completion 108. A downhole tool 114 may be positioned within the well system 100 below the lower completion string 110. The downhole tool 114 may be a tool that includes a remote actuator assembly. The downhole tool 114 may include for example, but is not limited to, a flow control device, a circulating sub, or any other suitable downhole tool. The downhole tool 114 may include an open position in which a valve mechanism is in an open position. In the open position fluid may flow from a surrounding formation 116 through the valve mechanism into an inner region of the downhole tool 114. The downhole tool 114 may also include a closed position in which the valve mechanism is in a closed position. In the closed position fluid flow may be prevented from flowing from the surrounding formation 116 through a valve mechanism into the inner region of the downhole tool 114. In the closed position, the downhole tool 114 may isolate the well system 100 from the surrounding formation 116. For example, the downhole tool 114 in the closed position may isolate the wellbore 102 from the surrounding formation 116 prior to installing the lower completion string 110.

The downhole tool 114 may be moved from the closed position to the open position in response to a signal from the surface of the wellbore 102. The signal from the surface may be a predetermined pressure signal from the surface. The predetermined pressure signal may fall within a "pressure window" that corresponds to a predetermined pressure range. The pressure window may also correspond to the predetermined pressure range being applied for a predetermined amount time. A pressure signal that falls outside of the predetermined pressure window, either by falling outside of the predetermined pressure range of pressure or predetermined amount of time of application may not cause the downhole tool 114 to actuate. A pressure signal that falls within the predetermined pressure window may cause the downhole tool 114 to actuate. The downhole tool 114 may be a mechanical tool that does not utilize electronics.

Figure 2:
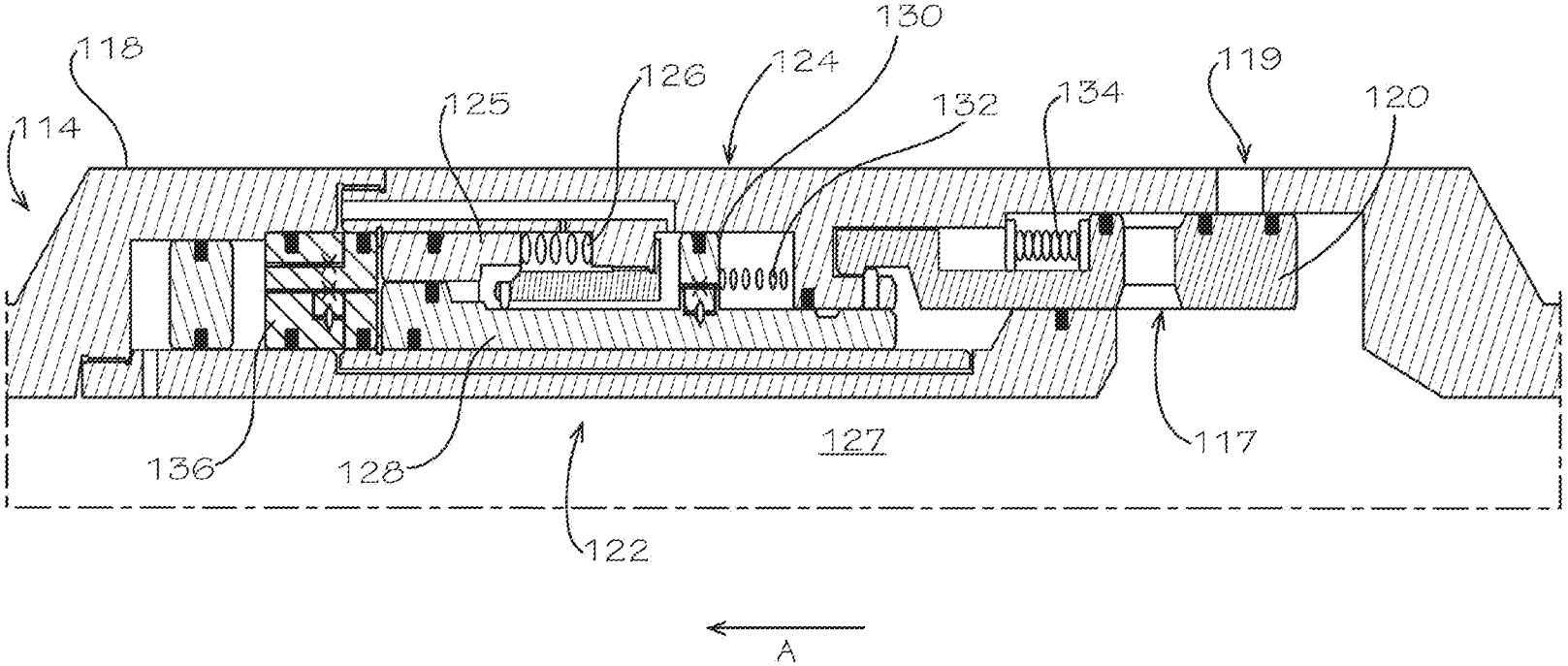
FIG. 2 is a cross-sectional side view of a portion of the downhole tool of FIG. 1 in a first position, according to an aspect of the present disclosure.

FIG. 2 depicts a cross-sectional side view of a portion of the downhole tool 114 in a first position according to an aspect of the present disclosure. The downhole tool 114 may include a tubing string 118 and a device that may be actuated from the surface, shown in FIG. 2 as a sliding sleeve 120, though in some aspects the device may be for example but not limited to a ball valve, a hydraulic piston, or other suitable remote actuation mechanisms. In some aspects, the sliding sleeve 120 may be replaced with a control arm or other linear actuation to perform a supplementary function. The supplementary function may include actuating the control arms of a rotational ball valve, a latch of a flapper valve, or to similarly energize another chamber of a hydraulically actuated device. In some aspects, the downhole tool 114 may include, but is not limited to a fluid control device. The downhole tool 114 may include an actuator assembly 122 for controlling actuation of the device, for example by controlling the position of the sliding sleeve 120. The sliding sleeve 120 includes an opening 117. The downhole tool 114 may be in an open position when the opening 117 of the sliding sleeve 120 is at least partially aligned with an opening 119 in the tubing string 118 of the downhole tool 114 such that fluid may flow from an outer surface 124 of the tubing string 118 to an inner region 127 of the tubing string 118. The downhole tool 114 may be in a closed position when the opening 117 of the sliding sleeve 120 is not aligned with the opening 119 in the tubing string 118 so as to prevent fluid flow from the outer surface 124 to the inner region 127 of the tubing string 118. In the closed position, the downhole tool 114 may isolate a well system from a surrounding formation. For example, the downhole tool 114 in the closed position may isolate the wellbore (shown in FIG. 1) from the formation prior to installing the lower completion string. In some aspects, the downhole tool 114 may include a plugging device installed within a tubing string for isolating sections of the tubing string. In some aspects, the downhole tool 114 may include a barrier type device that forms a part of the tubing string for isolating sections of the tubing string or in some aspects for isolating the well bore and the annulus.

The actuator assembly 122 of the downhole tool 114 can control the position of the sliding sleeve 120, for example moving the sliding sleeve 120 into the open position in response to an application of a pressure signal from the surface of the wellbore that falls within a predetermined pressure window. The predetermined pressure window can correspond to a predetermined pressure range and can also correspond to the predetermined pressure range being applied for a predetermined amount of time. In some aspects, actuation of the actuator assembly 122 may move the downhole tool 114 from an open position to a closed position or vice versa. The actuator assembly 122 may also hydrostatically balance the pressure chambers within the actuator assembly 122 with a pressure above and a pressure below the device that is being actuated (e.g. the sliding sleeve 120). By providing for hydrostatically balancing the pressure chambers of the actuator assembly 122 with the pressure above and below the device, the actuator assembly 122 is a self-zeroing assembly that does not require a user to calculate a pressure downhole prior to applying a signal pressure for actuating the actuator assembly 122. In some aspects, slow changes in pressure, for example but not limited to changes in pressure caused by running in-hole or due to small changes in hydrostatic can be differentiated from a pressure signal that is applied from the surface. Thus, in some aspects, the actuator assembly 122 can be actuated by only the pressure signal from the surface which provides rate of change in the pressure sufficient to actuate the downhole tool 114. The elements of the actuator assembly 122 can be contained within a clean fluid, for example hydraulic oil.

The actuator assembly 122 is shown in FIG. 2 in the first position in which no pressure signal from the surface is applied. The actuator assembly 112 may be hydrostatically balanced as shown in FIG. 2. The downhole tool 114 may be run-in-hole in the first position shown in FIG. 2. The actuator assembly 122 includes a locking piston 125 that is coupled to a spring 126. The first spring 126 has a spring force in a first direction indicated by the arrow A in FIG. 2.

The actuator assembly 122 also include a primary piston 128 that is coupled to a dampening restrictor 130. The primary piston 128 is also coupled to a spring 132. In some aspects, a boost spring 134 may be coupled to the sliding sleeve 120 to apply boost force to the sliding sleeve 120 which may aid in the positioning of the sliding sleeve 120. The actuator assembly 122 may also include a restrictor bulkhead 136 adjacent the primary piston 128 and the locking piston 125, the restrictor bulkhead 136 is described in further detail with reference to FIG. 4.

Figure 5:
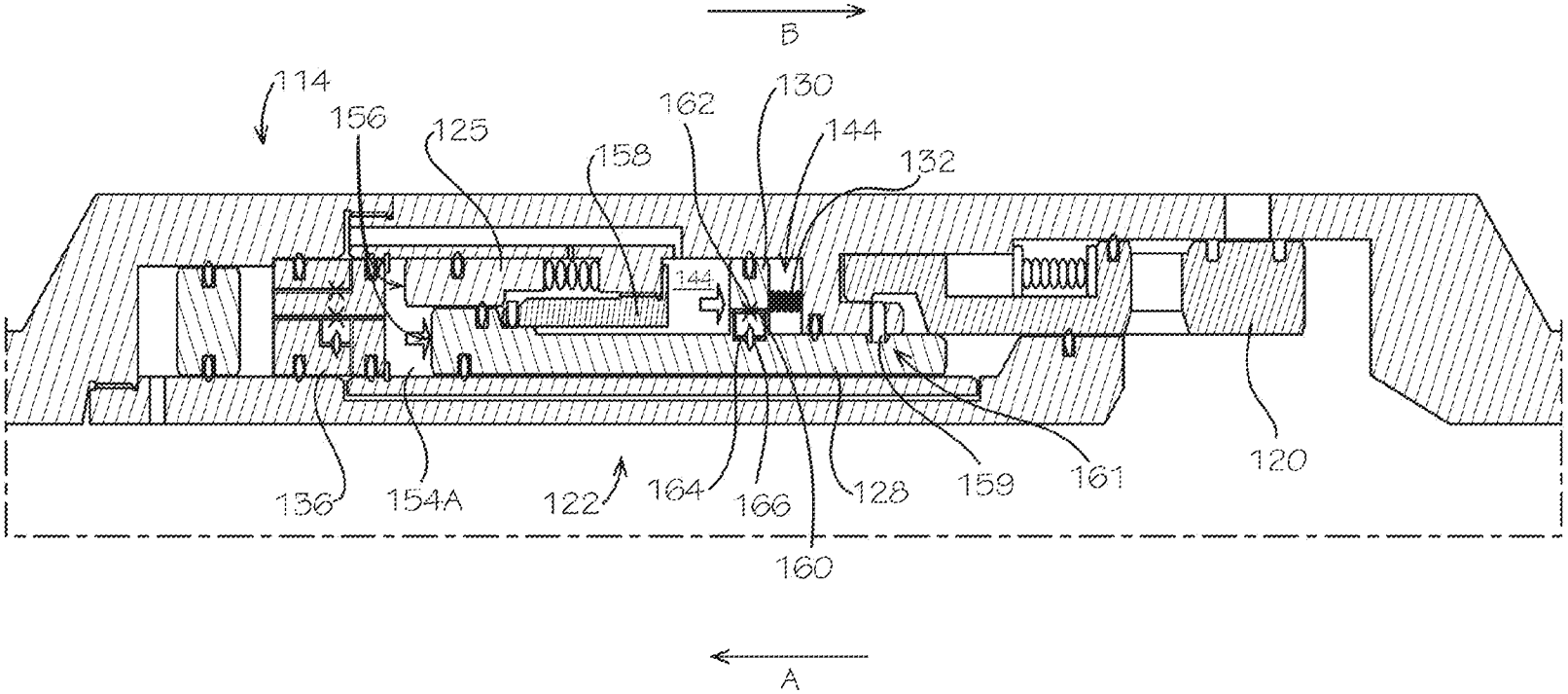
FIG. 5 is a cross-sectional side view of a portion of the downhole tool of FIG. 1 in a third position, according to an aspect of the present disclosure.
Figure 6:
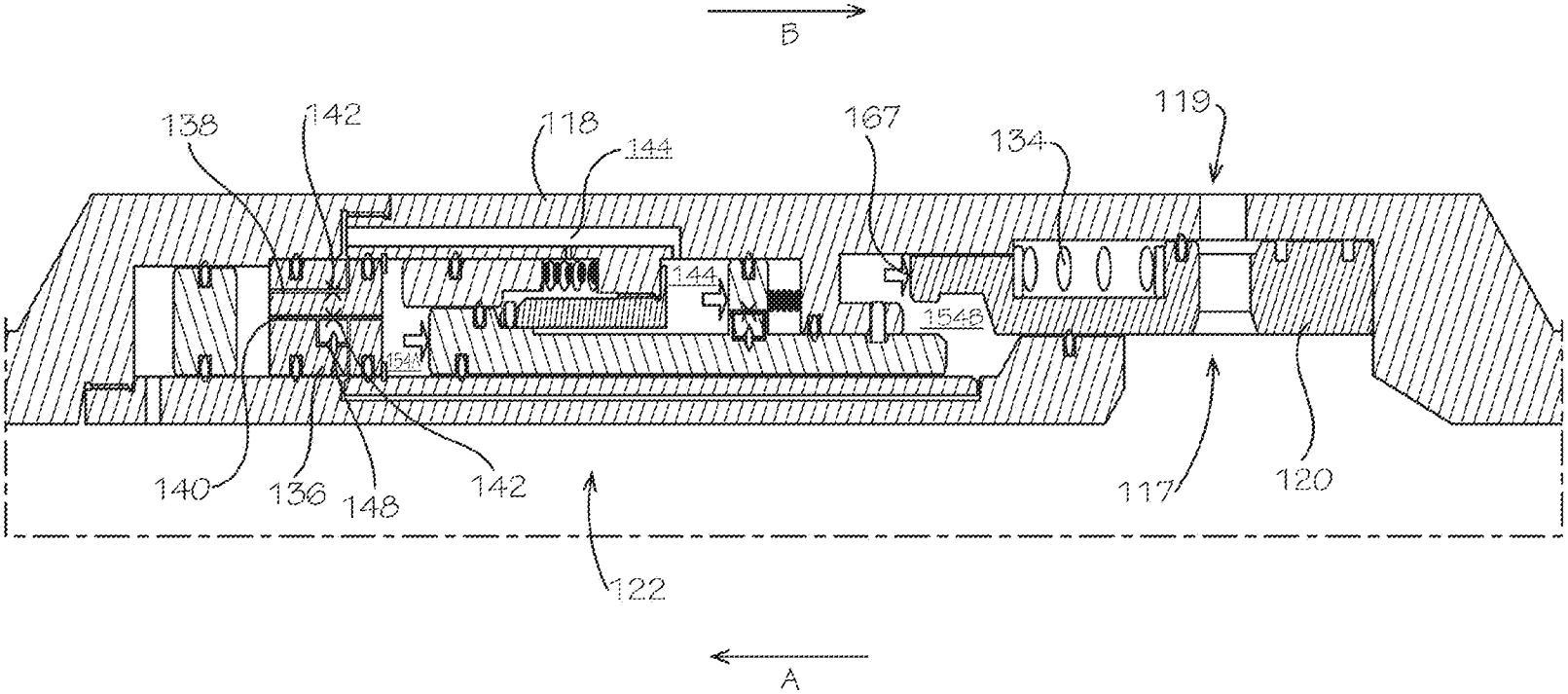
FIG. 6 is a cross-sectional side view of a portion of the downhole tool of FIG. 1 in a fourth position, according to an aspect of the present disclosure.

In the first position shown in FIG. 2, with no pressure applied or a slow pressure application from the surface the pressure within the actuator assembly 122 may be hydrostatically balanced. A rapid increase in applied pressure (sometimes referred to herein as "well bore pressure") creates a pressure differential above and below the locking piston 125 and the primary piston 128. The high pressure located in high pressure chamber 154A above the locking piston 125 and the primary piston 128, compared to the low pressure in the low pressure chamber 144 creates a force that may cause the pistons to travel in a second direction (shown by arrow B. When an applied pressure falls within the predetermined pressure window, this pressure differential can cause the primary piston 128 to actuate the sliding sleeve 120 (as shown in FIGS. 5 and 6). When a pressure is applied slowly from the surface the actuator assembly 122 may not actuate. Similarly, when a pressure is applied that falls below the predetermined pressure window the actuator assembly 122 can maintain the position shown in FIG. 2.

Figure 3:
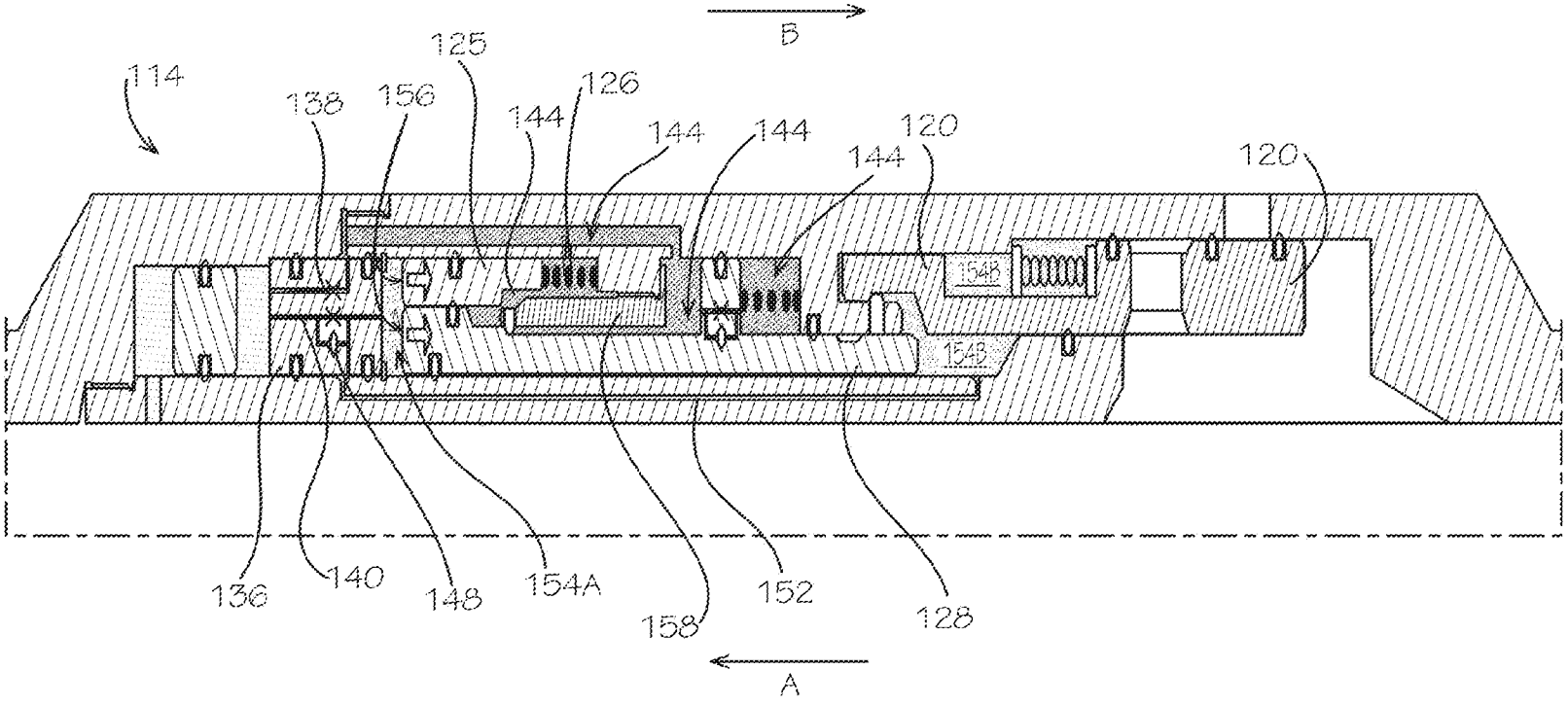
FIG. 3 is a cross-sectional side view of a portion of the downhole tool of FIG. 1 in a second position, according to an aspect of the present disclosure.
Figure 4:
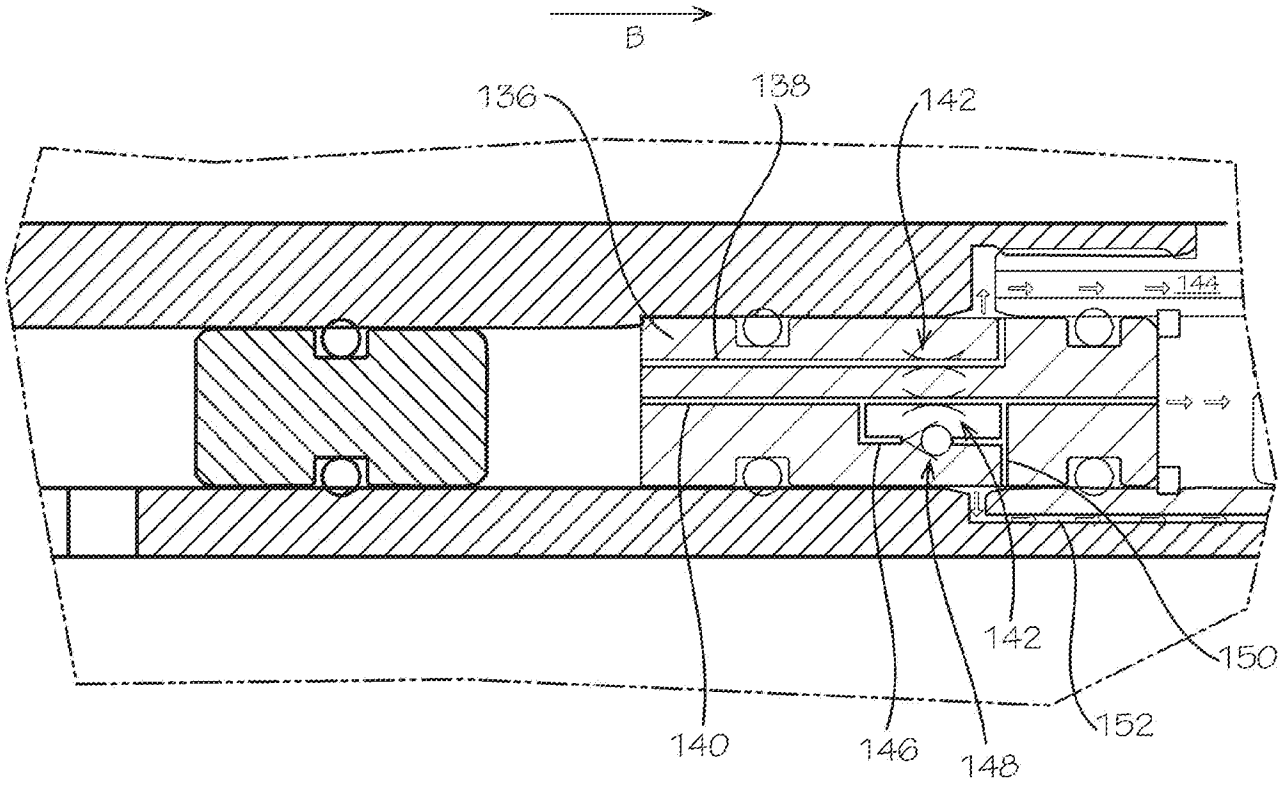
FIG. 4 is an enlarged cross-sectional side view of a portion of the downhole tool of FIG. according to an aspect of the present disclosure.

FIG. 3 depicts a cross-sectional side view of a portion of the downhole tool 114 in a second position according to an aspect of the present disclosure. In the second position shown in FIG. 3, a pressure signal from the surface is applied to the tool 114, including the actuator assembly 122. The pressure signal may be applied as a fast change in pressure that is less than the predetermined pressure window. The pressure applied from the surface can enter the restrictor bulkhead 136. As shown with reference to FIG. 4, the pressure signal enters a first passageway 138 and a second passageway 140 in the restrictor bulkhead 136. Pressure flowing through the first passageway 138 encounters a restrictor 142 that restricts the flow of fluid in either direction through the first passageway 138. The pressure exits the first passageway 138 and enters a low pressure chamber 144. The pressure that enters the second passageway 140 may pass through another restrictor 142 positioned in the second passageway 140 that restricts fluids in both directions. The pressure in the second passageway 140 may also enter a branch passageway 146 that includes a check valve 148 that allows fluid to pass through the check valve 148 in one direction only. As shown in FIGS. 3 and 4 the check valve 148 allows fluid to flow from a second direction indicated by arrow B. The pressure that has passed through the check valve 148 enters a third passageway 150 that is in fluid communication with a bypass channel 152 and a high pressure chamber. The high pressure chamber may comprise multiple chambers, for example a high pressure chamber 154A and a high pressure chamber 154B as depicted in FIG. 3. High pressure chamber 154A may act on the primary piston 128 and the locking piston 125. High pressure chamber 154B may act on the sliding sleeve 120 to aid in forcing the sliding sleeve 120 in the second direction following actuation of the sliding sleeve 120 by the primary piston 128. The bypass channel 152 may be at the same pressure as the high pressure chamber 154B to Which it is fluid communication. The pressure can pass through the bypass channel 152 and enter the high pressure chamber 154B within which the sliding sleeve 120 is positioned.

The pressure within the high pressure chamber 154A acts on the first ends 156 of the locking piston 125 and the primary piston 128, and can force those pistons in the second direction, partially compressing spring 126 and spring 132. The spring 132 may apply a force in the first direction (shown as arrow A) against the pressure force applied in the high pressure chamber 154A at the first end 156 of the primary piston 128. The applied pressure being below the predetermined command window is insufficient to overcome the force of the spring 126. A locking mechanism 158 can be positioned between the locking piston 125 and the primary piston 128. The locking mechanism 158 can be held in place when the locking piston 125 moves a predetermined amount in the second direction to engage with and hold the locking mechanism 158 in place. The primary piston 128 therefore does not travel in the second direction a sufficient amount to release and thereby actuate the sliding sleeve 120 to the open position. The locking mechanism 158 can move relative to the primary piston 128 to permit the primary piston 128 to move in the second direction beyond the locking mechanism 158 when the locking piston 125 does not engage with and retain the locking mechanism 158 in position.

A slow application of pressure, for example but not limited to small changes in hydrostatic pressure while at depth or during tool installation downhole, the low pressure chamber 144 and high pressure chambers 154A, 154B will remain balanced. The lack of a pressure differential across the pistons can prevent the tool from actuating.

The pressure within the low pressure chamber 144 and high pressure chambers 154A, 154B may bleed off, for example via the first passageway 138 and second passageway 140 in the restrictor bulkhead 136, and the primary piston 128 may return to the position shown in FIG. 2. In the position shown in FIG. 2 the downhole tool 114 may be hydraulically balanced above and below the locking piston 125 and the primary piston 128, thus the balanced pressure can "zero" the downhole tool 114 at its deployed depth. A subsequent application of pressure can be applied to the downhole tool 114 without requiring further calculation of the hydrostatic pressure at the depth of the downhole tool 114.

FIG. 5 depicts a cross-sectional side view of a portion of the downhole tool 114 in a third position just prior to the sliding sleeve 120 being actuated to the open position, according to an aspect of the present disclosure. In the third position shown in FIG. 5, a pressure signal from the surface is applied to the actuator assembly 122 in an amount that falls within the predetermined pressure window (i.e. the within the predetermined pressure range for the predetermined amount of time). The pressure signal again passes through the restrictor bulkhead 136 and into the high pressure chamber 154A and is sufficiently high to force the primary piston 128 to move in the second direction (shown by arrow B). The pressure within the high pressure chamber 154A at the first ends 156 of the primary piston 128 and the locking piston 125 is sufficient to force the primary piston 128 to move in the second direction and compress the spring 132. The pressure signal is also low enough to prevent the locking piston 125 from moving in the second direction a sufficient amount to lock the locking mechanism 158 in place. Thus, with the locking mechanism 158 not being locked or retained in place by the locking piston 125, the locking mechanism 158 can move upwards and away from the primary piston 128 as the primary piston 128 moves in the second direction. This movement of the locking mechanism can permit the primary piston 128 to travel past the locking mechanism 158 in the second direction. The dampening restrictor 130 prevents the primary piston 128 from moving quickly by permitting fluid to be circulated slowly.

The dampening restrictor 130 includes a first passageway 160 that includes a restrictor 162 and a second passageway 164 that includes a check valve 166 that prevents fluid flow in the first direction (shown by arrow A). Each of the first and second passageways 160, 164 are in fluid communication with the low pressure chamber 144 on either side of the dampening restrictor 130, including the low pressure chamber 144 in which the spring 132 is positioned. Pressure within the high pressure chamber 154B may act against the first end 167 of the sliding sleeve 120 to further force the sliding sleeve 120 in the second direction (shown by arrow B) once the downhole tool 114 is actuated. The dampening restrictor 130 may slow the travel of the primary piston 128 in the second direction as described further below.

The slowing of the movement of the primary piston 128 in the second direction may generate the time element of the predetermined pressure window where the application at the surface was for a time period less than the predetermined pressure window. This in effect can incorporate a delay in the application of pressure to the primary piston 128. For example, the dampening restrictor 130 may provide for an application of pressure on the primary piston 128 by the high pressure chamber 154A even after the pressure signal has been removed as pressure within the high pressure chamber 154A will remain until pressure bleeds off slowly via the restriction 140. The delay provided by the dampening restrictor 130 can allow a pressure signal from the surface to be applied, then bled off, with the downhole tool 114 being subsequently actuated as a result of the pressure trapped in the high pressure chamber 154A continuing to act on the primary piston 128 after the bleeding off of the signal at the surface. Thus, while the time period that the pressure signal is applied from the surface may not fall within the predetermined pressure window, the pressure applied to the primary piston 128 may be for a period of time that falls within the predetermined pressure window to actuate the downhole tool 114. Thus, a quick change in the applied pressure (i.e. the pressure signal) can be applied to the primary piston 128 over a longer period of time than the actual application of pressure at the surface at least in part because of the performance of the dampening restrictor 130 and the function of the high pressure chamber 154 bleeding off pressure slowly via the restriction 140.

As the primary piston 128 moves in the second direction a predetermined amount in response to the pressure signal falling within the predetermined pressure window, a projection 159 can align with a recess 161 in the surface of the primary piston 128. The projection 159 by aligning within the recess 161 of the primary piston 128 can disengage from its coupling to a surface of the sliding sleeve 120. The sliding sleeve 120, no longer retained in place by the projection 159 can move in the second direction.

FIG. 6 depicts the actuator assembly 122 in a fourth position just after the sliding sleeve 120 has been forced in the second direction (shown by arrow B) by the pressure applied at the first end 167 of the sliding sleeve 120. The pressure within the high pressure chamber 154B can to act on the sliding sleeve 120 even after the pressure signal from the surface has been bled off. In addition the boost spring 134 has been released applying an additional boost force in the second direction further forcing the sliding sleeve 120 in the second direction causing the sliding sleeve 120 to actuate to the open position. The boost spring 134 is optional and the sliding sleeve 120 may be actuated to the open position without the inclusion of the boost spring 134. In the open position, the opening 117 within the sliding sleeve at least partially aligns with the opening 119 in the tubing string 118.

A pressure signal applied from the surface can be maintained or bled off prior to actuating the sleeve 120. The check valve 148 within the restrictor bulkhead 136 can retain the pressure applied from the surface inside the high pressure chamber 154 even if the pressure signal is bled off just prior to the release or actuation of the sliding sleeve 120. The check valve 148 can prevent the pressure from flowing through the check valve 148 in the first direction (shown by arrow A) while the restrictor 142 in the first passageway 138 and the restrictor 142 in the second passageway 140 allow pressure to slowly bleed off through the first and second passageways 138, 140. Thus, the check valve 148 may aid in trapping the pressure applied from the surface within the high pressure chambers 154A and 154B. The pressure signal thereby may remain within the downhole tool 114 and may continue to act on the actuator assembly 122 over a period of time. Thus, a delay can be incorporated into the system to allow pressure to be applied to the actuator assembly 122 in order to activate the downhole tool 114 but permit the pressure within the actuator assembly 122 to be bled off prior to the valve actuating. This can prevent or reduce surging in the well. The maintained pressure within the high pressure chamber 154A can force the primary piston 128 a sufficient amount in the second direction to actuate the sliding sleeve 120 even after the pressure has been bled off. Thus, the check valve 148 can aid in generating the time element of the predetermined time range by maintaining the pressure within the high pressure chamber 154A over a time period greater than the actual application of the pressure at the surface. Similarly, the pressure maintained in the high pressure chamber 154B can act on the sliding sleeve 120 following the activation of the downhole tool even after the pressure signal has been bled off.

The pressure within the low pressure chamber 144 can be lower than the pressure within the high pressure chambers 154A, 154B when a pressure signal is applied from a surface of the wellbore. The restrictor bulkhead 136 may discharge and balance the hydrostatic pressure within the hydraulic chambers (low pressure chamber 144 and high pressure chambers 154A, 154B) slowly over a period of time once the pressure signal applied from the surface has been removed.

Figure 7:
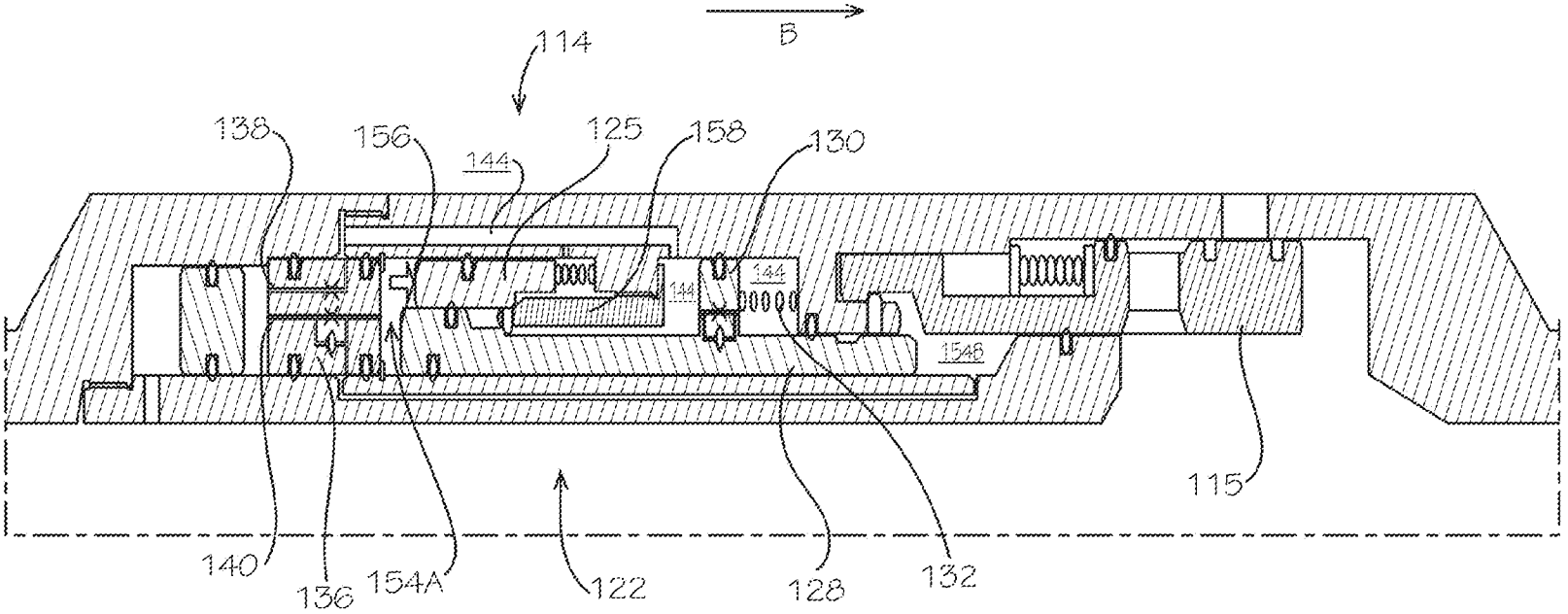
FIG. 7 is a cross-sectional side view of a portion of the downhole tool of FIG. 1 in a fifth position, according to an aspect of the present disclosure.

FIG. 7 depicts a cross-sectional side view of a portion of the downhole tool 114 in a fifth position in response to an application of pressure from the surface that is above the predetermined pressure window according to an aspect of the present disclosure. In the fourth position shown in FIG. 7, a pressure signal from the surface is applied to the actuator assembly 122. The pressure signal may be greater than the predetermined pressure range for the predetermined pressure window for actuation of the downhole tool 114. The pressure signal from the surface can again pass through the first and second passageways 138 and 140 of the restrictor bulkhead 136 and enter the low pressure chamber 144 and high pressure chambers 154A, 154B. The pressure within the high pressure chamber 154A can apply a force to the first end 156 of the primary piston 128 forcing the primary piston to move in the second direction (shown by arrow B). When the primary piston 128 moves in the second direction the volume of fluid below the dampening restrictor 130 may communicate with the fluid above the dampening restrictor 130. The primary piston 128 may move slowly as a result of the dampening restrictor 130 which slows down the circulation of fluid at either side of the dampening restrictor 130 (shown with low pressure chambers 144 on either side of the dampening restrictor 130). Similarly, when the primary piston 128 moves in the first direction (shown by arrow A) a fluid may circulate above and below the dampening restrictor 130 slowing hate movement of the primary piston 128. While the primary piston 128 may move slowly in the second direction in response to function of the dampening restrictor 130, the locking piston 125 has no corresponding restrictor and thus may move quickly in the second direction activating the locking mechanism 158 such that the locking mechanism 158 latches against the primary piston 128 and the locking piston 125 to prevent the primary piston 128 from traveling further in the second direction. The primary piston 128 is thus prevented from traveling in the second direction a sufficient amount to release the locking sleeve 115. The actuator assembly 122 may again become hydrostatically balanced as the pressure is allowed to slowly bleed off from the low pressure chamber 144 and the high pressure chambers 154A. 154B.

Figure 8:
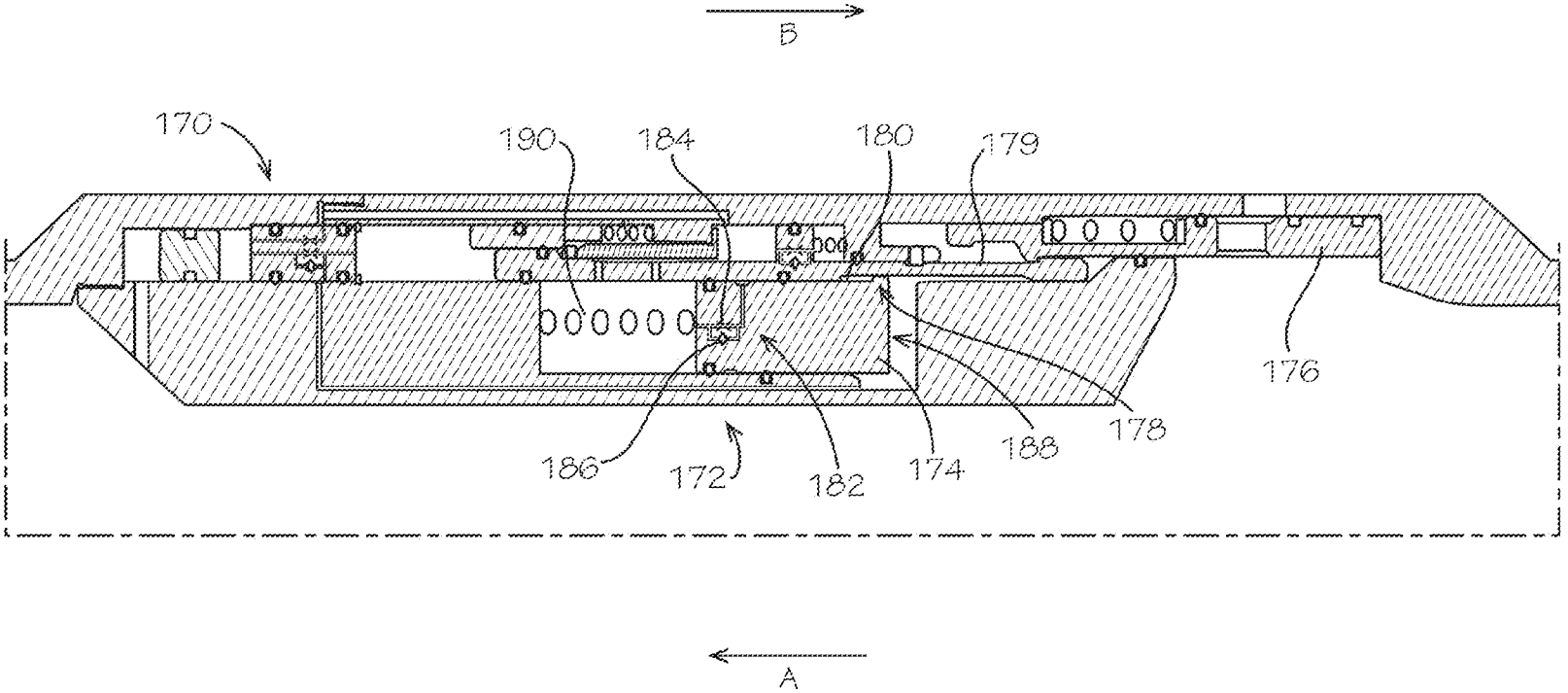
FIG. 8 is a cross-sectional side view of a portion of a downhole tool in a first position, according to an aspect of the present disclosure.

In some aspects, as shown in FIG. 8, a downhole tool 170 may include an actuator assembly 172 that includes the features described above respect to the actuator assembly 122 (e.g., low pressure chamber, high pressure chambers, a locking piston, a primary piston, a locking mechanism, and various springs) in addition to a tertiary piston 174 that permits the actuator assembly 172 to have multi-cycling capability. The actuator assembly 172 can also be actuated from the closed position to the open position in much the same manner as described above with respect to actuator assembly 122 described in FIGS. 2-7, The actuator assembly 172 can have multi-cycling capability such that a device, for example sliding sleeve 176 of the downhole tool 170, can be actuated repeatedly on demand by application of a pressure signal from a surface of the wellbore. FIG. 8, depicts the actuator assembly 172 with the sliding sleeve 176 in a first position corresponding to an open or actuated position. A pressure signal applied from the surface that falls within a predetermined pressure window can actuate the actuator assembly 172 from the open position to the closed position (shown in FIG. 10). In some aspects, the pressure window for actuating the actuator assembly 172 from the closed to the open position may be the same or a different pressure window for actuating the actuator assembly 172 from the open to the closed position. In some aspects, the pressure range to actuate the actuator assembly 172 from an open to closed position and from the closed to open position may be the same, but the time ranges of the predetermined pressure windows may be different. In some aspects, the pressure range to actuate the actuator assembly 172 from an open to closed position and from the closed to open position may be the different, but the time ranges of the predetermined pressure windows may be the same. In still yet other aspects, the pressure range to actuate the actuator assembly 172 from an open to closed position and from the closed to open position may be the different, and the time ranges of the predetermined pressure windows may be different.

As shown in FIG. 8, the tertiary piston 174 includes a projection or shoulder 178 that is sized and shaped to engage with a projection or shoulder 180 on the primary piston 179. The tertiary piston 174 may also include a restrictor assembly 182 that includes a restrictor 184 and a check valve 186. The restrictor assembly 182 can slow the travel of the tertiary piston 174 in the first direction (shown by arrow A). A gap in the longitudinal spacing of the shoulder 178 of the tertiary piston 174 and the shoulder of the primary piston 179 can allow for the tertiary piston 174 to travel a predetermined amount before it picks up the primary piston 179. This spacing between the tertiary piston 174 and the primary piston 179 can prevent the primary piston 179 from actuating the sliding sleeve 176 inadvertently in response to the tertiary piston 174 traveling less than the predetermined amount. The actuator assembly 172 is shown in FIG. 8 in a hydrostatically balanced position. If a pressure signal from the surface is applied that falls below the predetermined window, the force applied on an end 188 of the tertiary piston 174 in the first direction is insufficient to overcome the force of the spring 190 in the second direction (shown by arrow B) to move the tertiary piston 174 the predetermined amount to engage with and move the primary piston 179.

Figure 9:
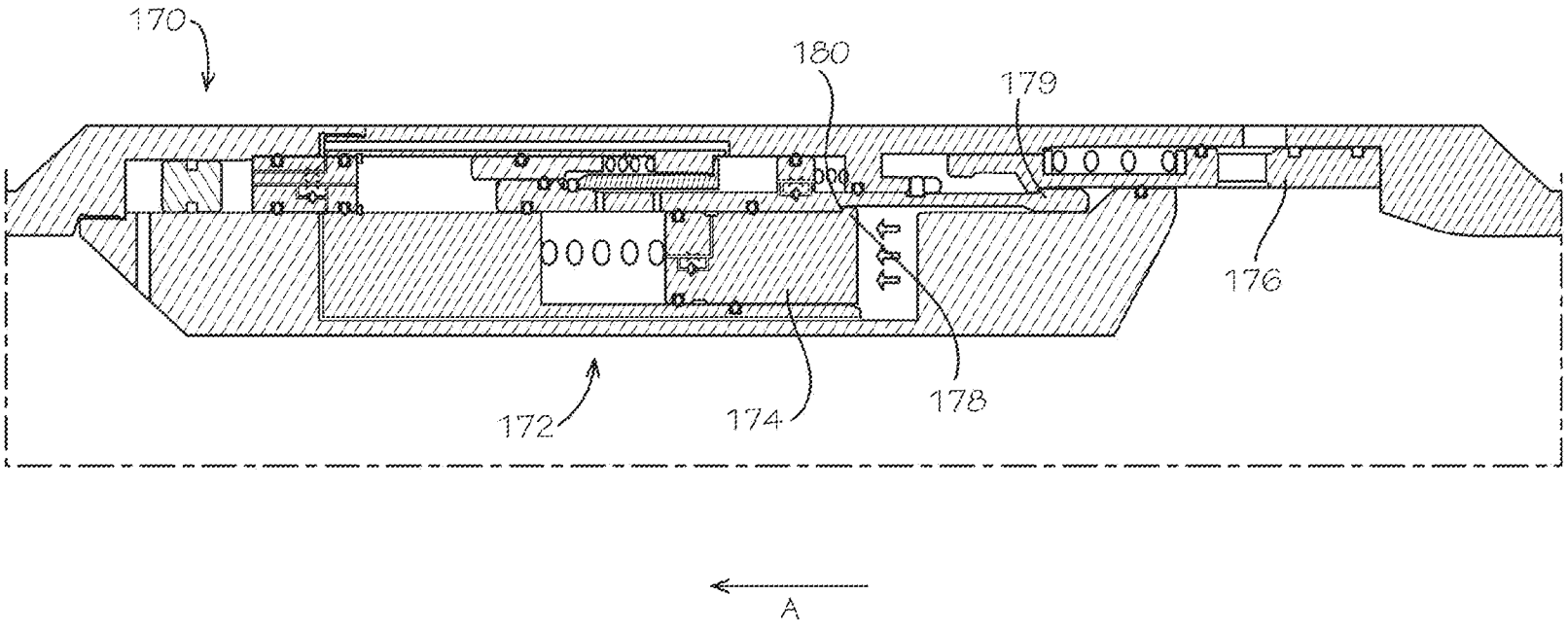
FIG. 9 is a cross-sectional side view of a portion of the downhole tool of FIG. 8 in a second position, according to an aspect of the present disclosure.

FIG. 9 depicts the actuator assembly 172 of the downhole tool 170 in a second position in which a pressure signal from the surface is within the predetermined pressure window and prior to the movement of the tertiary piston 174 causing the sliding sleeve 176 to actuate. As shown in FIG. 9, the tertiary piston 174 has moved in the first direction (shown by arrow A) in response to the pressure signal and the shoulder 178 of the tertiary piston 174 has contacted the shoulder 180 of the primary piston 179 and has coupled to the primary piston 179 in this manner. The tertiary piston 174 has not moved enough yet in the first direction to force the primary piston 179 in the first direction with the tertiary piston 174.

Figure 10:
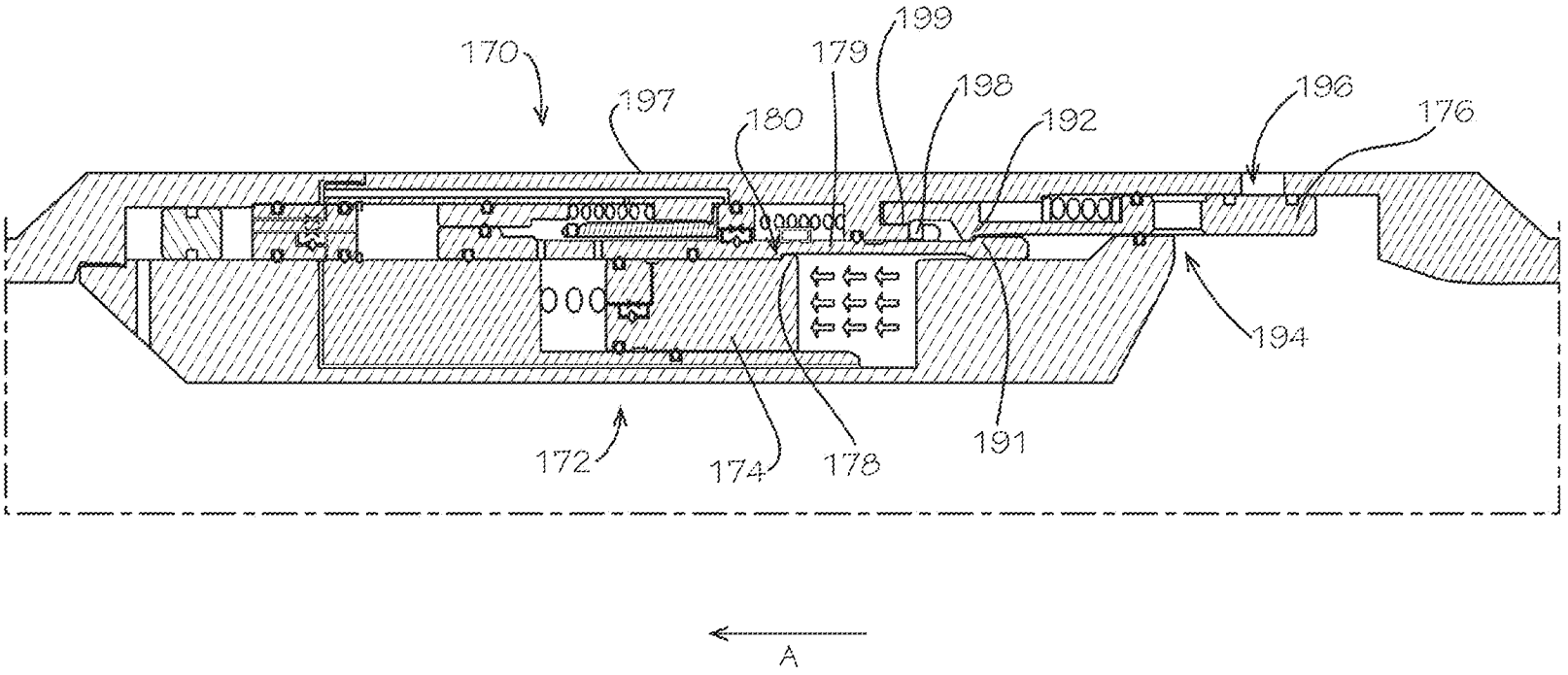
FIG. 10 is a cross-sectional side view of a portion of the downhole tool of FIG. 8 in a third position, according to an aspect of the present disclosure.

FIG. 10 depicts the actuator assembly 172 of the downhole tool 170 in a third position in which the tertiary piston 174 has traveled a sufficient amount in the first direction (shown by arrow A) to couple with the primary piston 179 via the shoulders 178, 180 and move the primary piston 179 in the first direction. A projection or shoulder 191 of the primary piston 179 can engage with a projection or shoulder 192 of the sliding sleeve 176. The sliding sleeve 176 can be moved in the first direction with the movement of the primary piston 179 by the engagement between the primary piston 179 and the sliding sleeve 176. As shown in FIG. 10, the tertiary piston 174 has moved a sufficient amount in the first direction in response to the pressure signal falling within the predetermined pressure window to move the primary piston 179 a sufficient amount to actuate the sliding sleeve 176 from the open position to the closed position. The sliding sleeve 176 is shown having moved a sufficient amount in the first direction to move from the open position to the closed position in which an opening 194 in the sliding sleeve 176 is not aligned with an opening 196 in a tubing 197 of the downhole tool 170. Once the tertiary piston 174 has fully traveled in the first direction, the sliding sleeve 176 may be locked back in place via a locking mechanism 198 that engages with a shoulder 199 of the sliding sleeve 176 to hold the sliding sleeve 176 in position.

As used below, any reference to a series of examples is to be understood as a reference to each of those examples disjunctively (e.g., "Examples 1-4" is to be understood as "Examples 1, 2, 3, or 4").

Example 1 is a downhole tool positionable within a wellbore, the downhole tool comprising: a housing having an outer surface that defines an inner region and an outer region of the housing; a primary piston positioned within the inner region of the housing for actuating an actuator piston between an open and a closed position in response to a pressure signal from a surface falling within a predetermined pressure window; and a restrictor apparatus including a first fluid pathway in fluid communication with a low pressure chamber and a second fluid pathway in fluid communication with a first high pressure chamber and a second high pressure chamber, wherein the restrictor apparatus includes a restrictor device and a check valve for generating a pressure differential between the low pressure chamber and each of the first and second high pressure chambers, wherein the first high pressure chamber is positioned at a first end of the primary piston for applying a force to the primary piston in the first direction for actuating the actuator piston between the open and the closed position.

Example 2 is the downhole: tool of example 1, further comprising: a locking piston positioned within the inner region of the housing and coupled to a spring to exert a force in a second direction opposite the first direction, wherein the first high pressure chamber is positioned at a first end of the locking piston for applying a force to the locking piston in the first direction.

Example 3 is the downhole tool of examples 1-2, wherein the restrictor device is positioned within the first fluid pathway.

Example 4 is the downhole tool of examples 1-3, wherein the second high pressure chamber is positioned at a first end of the actuation piston for applying a force to the actuation piston in the first direction to force the actuation piston between the open and the closed position.

Example 5 is the downhole tool of examples 1-4, wherein the primary piston further comprises a dampening restrictor including a second restrictor device and a second check valve for restraining a fluid flow between a first region of the low pressure chamber at a first side of the dampening restrictor and a second region of the pressure chamber at a second side of the dampening restrictor.

Example 6. The downhole tool of examples 1-5, further comprising an additional restrictor device positioned in the second fluid pathway for restricting a fluid flow from the first high pressure chamber through a portion of the second fluid pathway.

Example 7 is the downhole tool of examples 1-6, further comprising a boost spring positioned adjacent a first end of an actuation piston for applying a boost force to the first end of the actuation piston in the first direction in response to the primary piston moving a predetermined amount in the first direction.

Example 8 is the downhole tool of examples 1-7, further comprising a tertiary piston having a surface feature sized and shaped to couple to a surface feature of the primary piston for moving the primary piston a predetermined amount in a second direction in response to a pressure signal from the surface falling within a predetermined window, wherein the second direction is opposite the first direction.

Example 9 is the downhole tool of example 8, further comprising a spring coupled to the tertiary piston for exerting a force in the first direction on an end of the tertiary piston.

Example 10 is an actuator assembly of a downhole tool, the actuator assembly comprising: a plurality of pistons; a low pressure chamber defined at least in part by the plurality of pistons and an inner surface of the downhole tool; a first high pressure chamber defined at least in part by the plurality of pistons and the inner surface of the downhole tool; a second high pressure chamber defined at least in pail by the plurality of pistons and the inner surface of the downhole tool; and a restrictor apparatus positioned adjacent a first end of the actuator assembly, the restrictor apparatus including a low pressure pathway within which a restrictor device is positioned, and a high pressure pathway within which a check valve is positioned, wherein the low pressure pathway is in fluid communication with a the low pressure chamber, wherein the high pressure pathway is in fluid communication with the first high pressure chamber and the second high pressure chamber, and wherein the check valve is a one-way check valve for allowing a pressure signal from a surface of a wellbore to pass through the check valve into the first and second high pressure chambers and for preventing an amount of pressure from flowing from the first and second high pressure chambers through the check valve in an opposite direction.

Example 11 is the actuator assembly of example 10, wherein the high pressure pathway includes a first passageway within which an additional restrictor device is positioned.

Example 12 is the actuator assembly of examples 10-11, wherein high pressure pathway includes a second passageway within which the check valve is positioned.

Example 13 is the actuator assembly of examples 10-12, wherein the plurality of pistons includes a primary piston, wherein the first high pressure chamber is positioned at a first end of the primary piston for applying a force to the first end of the primary piston in a first direction.

Example 14 is the actuator assembly of example 13, wherein the primary, piston further comprises a dampening restrictor including a second restrictor device and a second check valve for restraining a fluid flow between a first region of the low pressure chamber at a first side of the dampening restrictor and a second region of the low pressure chamber at a second side of the dampening restrictor Example 15 is a method of actuating a tool positioned downhole in a wellbore, the method comprising: applying a pressure signal from a surface of the wellbore; passing an amount of pressure of the pressure signal through a restrictor bulkhead into a low pressure chamber; passing an amount of pressure of the pressure signal through the restrictor bulkhead into a first high pressure chamber; passing an amount of pressure of the pressure signal through the restrictor bulkhead into a second high pressure chamber; and moving a primary piston in a first direction a predetermined amount to actuate an actuator piston in response to the pressure signal from the surface of the wellbore being within a predetermined pressure window, wherein a pressure within the first high pressure chamber applies a force to a first end of the primary piston for moving the primary piston in the first direction the predetermined amount.

Example 16 is the method of actuating a tool positioned downhole in a wellbore of example 15, further comprising bleeding off the pressure signal at the surface of the wellbore prior to moving the primary piston in the first direction the predetermined amount.

Example 17 is the method of actuating a tool positioned downhole in a wellbore of examples 15-16, further comprising: applying a second pressure from a surface of the wellbore to the tool downhole; and moving the primary piston the predetermined amount in a second direction opposite the first direction in response to the second pressure being within a second predetermined pressure window.

Example 18 is the method of actuating a tool positioned downhole in a wellbore of example 17, further comprising applying a force to a first end of the actuation piston in the first direction to actuate the actuation piston in response to the pressure signal from the surface being within the predetermined pressure window, wherein a pressure within the second high pressure chamber applies the force to the first end of the actuation piston in the first direction to actuate the actuation piston.

Example 19 is the method of actuating a tool positioned downhole in a wellbore of example 18, wherein the first predetermined pressure window is the same as the second predetermined pressure window.

Example 20 is the method of actuating a tool positioned downhole in a wellbore of examples 15-19, further comprising: bleeding off a pressure within the low pressure chamber, a pressure within the first high pressure chamber, and a pressure within the second high pressure chamber through the restrictor bulkhead for returning the tool to a hydrostatic pressure.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

That which is claimed is:

1. A downhole tool positionable within a wellbore, the downhole tool comprising:

a housing having an outer surface that defines an inner region and an outer region of the housing;

a primary piston positioned within the inner region of the housing for actuating an actuator piston between an open and a closed position in response to a pressure signal from a surface falling within a predetermined pressure window;

a restrictor apparatus including a first fluid pathway in fluid communication with a low pressure chamber and a second fluid pathway in fluid communication with a first high pressure chamber and a second high pressure chamber, wherein the restrictor apparatus includes a restrictor device and a check valve for generating a pressure differential between the low pressure chamber and each of the first and second high pressure chambers; and a tertiary piston having a surface feature sized and shaped to couple to a surface feature of the primary piston for moving the primary piston a predetermined amount in a second direction in response to a pressure signal from the surface falling within a predetermined window, wherein the second direction is opposite a first direction, wherein the first high pressure chamber is positioned at a first end of the primary piston for applying a force to the primary piston in the first direction for actuating the actuator piston between the open and the closed position.

2. The downhole tool of claim 1, further comprising:

a locking piston positioned within the inner region of the housing and coupled to a spring to exert a force in a second direction opposite the first direction, wherein the first high pressure chamber is positioned at a first end of the locking piston for applying a force to the locking piston in the first direction.

3. The downhole tool of claim 1, wherein the restrictor device is positioned within the first fluid pathway.

4. The downhole tool of claim 1, wherein the second high pressure chamber is positioned at a first end of the actuation piston for applying a force to the actuation piston in the first direction to force the actuation piston between the open and the closed position.

5. The downhole tool of claim 1, wherein the primary piston further comprises a dampening restrictor including a second restrictor device and a second check valve for restraining a fluid flow between a first region of the low pressure chamber at a first side of the dampening restrictor and a second region of the low pressure chamber at a second side of the dampening restrictor.

6. The downhole tool of claim 1, further comprising an additional restrictor device positioned in the second fluid pathway for restricting a fluid flow from the first high pressure chamber through a portion of the second fluid pathway.

7. The downhole tool of claim 1, further comprising a boost spring positioned adjacent a first end of an actuation piston for applying a boost force to the first end of the actuation piston in the first direction in response to the primary piston moving a predetermined amount in the first direction.

8. The downhole tool of claim 1, further comprising a spring coupled to the tertiary piston for exerting a force in the first direction on an end of the tertiary piston.

9. An actuator assembly of a downhole tool, the actuator assembly comprising:

a plurality of pistons;

a low pressure chamber defined at least in part by the plurality of pistons and an inner surface of the downhole tool;

a first high pressure chamber defined at least in part by the plurality of pistons and the inner surface of the downhole tool;

a second high pressure chamber defined at least in part by the plurality of pistons and the inner surface of the downhole tool; and a restrictor apparatus positioned adjacent a first end of the actuator assembly, the restrictor apparatus including a low pressure pathway within which a restrictor device is positioned, and a high pressure pathway within which a check valve is positioned, wherein the low pressure pathway is in fluid communication with the low pressure chamber, wherein the high pressure pathway is in fluid communication with the first high pressure chamber and the second high pressure chamber, and wherein the check valve is a one-way check valve for allowing a pressure signal from a surface of a wellbore to pass through the check valve into the first and second high pressure chambers and for preventing an amount of pressure from flowing from the first and second high pressure chambers through the check valve in an opposite direction.

10. The actuator assembly of claim 9, wherein the high pressure pathway includes a first passageway within which an additional restrictor device is positioned.

11. The actuator assembly of claim 10, wherein high pressure pathway includes a second passageway within which the check valve is positioned.

12. The actuator assembly of claim 9, wherein the plurality of pistons includes a primary piston, wherein the first high pressure chamber is positioned at a first end of the primary piston for applying a force to the first end of the primary piston in a first direction.

13. The actuator assembly of claim 12, wherein the primary piston further comprises a dampening restrictor including a second restrictor device and a second check valve for restraining a fluid flow between a first region of the low pressure chamber at a first side of the dampening restrictor and a second region of the low pressure chamber at a second side of the dampening restrictor.

14. A method of actuating a tool positioned downhole in a wellbore, the method comprising:

applying a pressure signal from a surface of the wellbore;

passing an amount of pressure of the pressure signal through a restrictor bulkhead into a low pressure chamber;

passing an amount of pressure of the pressure signal through the restrictor bulkhead into a first high pressure chamber;

passing an amount of pressure of the pressure signal through the restrictor bulkhead into a second high pressure chamber; and moving a primary piston in a first direction a predetermined amount to actuate an actuator piston in response to the pressure signal from the surface of the wellbore being within a predetermined pressure window, wherein a pressure within the first high pressure chamber applies a force to a first end of the primary piston for moving the primary piston in the first direction the predetermined amount.

15. The method of actuating a tool positioned downhole in a wellbore of claim 14, further comprising bleeding off the pressure signal at the surface of the wellbore prior to moving the primary piston in the first direction the predetermined amount.

16. The method of actuating a tool positioned downhole in a wellbore of claim 14, further comprising:

applying a second pressure from a surface of the wellbore to the tool positioned downhole; and moving the primary piston the predetermined amount in a second direction opposite the first direction in response to the second pressure being within a second predetermined pressure window.

17. The method of actuating a tool positioned downhole in a wellbore of claim 16, further comprising applying a force to a first end of the actuation piston in the first direction to actuate the actuation piston in response to the pressure signal from the surface being within the predetermined pressure window, wherein a pressure within the second high pressure chamber applies the force to the first end of the actuation piston in the first direction to actuate the actuation piston.

18. The method of actuating a tool positioned downhole in a wellbore of claim 17, wherein the predetermined pressure window is the same as the second predetermined pressure window.

19. The method of actuating a tool positioned downhole in a wellbore of claim 14, further comprising:

bleeding off a pressure within the low pressure chamber, a pressure within the first high pressure chamber, and a pressure within the second high pressure chamber through the restrictor bulkhead for returning the tool to a hydrostatic pressure.

20. A downhole tool positionable within a wellbore, the downhole tool comprising:

a housing having an outer surface that defines an inner region and an outer region of the housing;

a primary piston positioned within the inner region of the housing for actuating an actuator piston between an open and a closed position in response to a pressure signal from a surface falling within a predetermined pressure window;

a restrictor apparatus including a first fluid pathway in fluid communication with a low pressure chamber and a second fluid pathway in fluid communication with a first high pressure chamber and a second high pressure chamber, wherein the restrictor apparatus includes a restrictor device and a check valve for generating a pressure differential between the low pressure chamber and each of the first and second high pressure chambers; and a locking piston positioned within the inner region of the housing and coupled to a spring to exert a force in a second direction opposite a first direction, wherein the first high pressure chamber is positioned at a first end of the locking piston for applying a force to the locking piston in the first direction, wherein the first high pressure chamber is positioned at a first end of the primary piston for applying a force to the primary piston in the first direction for actuating the actuator piston between the open and the closed position.

* * * * *